US008282398B2

(12) United States Patent
Knoedgen

(10) Patent No.: US 8,282,398 B2
(45) Date of Patent: Oct. 9, 2012

(54) ENERGY TRANSFER VIA ROLLING ELEMENTS OF ROLLING-ELEMENT BEARINGS

(75) Inventor: Horst Knoedgen, Munich (DE)

(73) Assignee: Digital Imaging Systems GmbH, Kirchheim/Teck-Nabern (DE)

( * ) Notice: Subject to any disclaimer, the term of this patent is extended or adjusted under 35 U.S.C. 154(b) by 78 days.

(21) Appl. No.: 12/799,767

(22) Filed: Apr. 30, 2010

(65) Prior Publication Data

US 2011/0269317 A1 Nov. 3, 2011

(51) Int. Cl.
*H01R 41/00* (2006.01)

(52) U.S. Cl. ..... 439/32; 359/824

(58) Field of Classification Search ..... 359/824; 396/55, 72, 73, 469; 439/32
See application file for complete search history.

(56) References Cited

U.S. PATENT DOCUMENTS

| | | | | |
|---|---|---|---|---|
| 6,180,901 | B1 | 1/2001 | Bauer et al. | |
| 7,043,146 | B2 | 5/2006 | Semaza | |
| 7,109,610 | B2 | 9/2006 | Tamai | |
| 7,764,448 | B2 * | 7/2010 | Chang | 359/824 |
| 7,783,179 | B2 * | 8/2010 | Takahashi | 396/55 |
| 7,986,478 | B2 * | 7/2011 | Yamashita et al. | 359/824 |
| 8,014,091 | B2 * | 9/2011 | Kang et al. | 359/824 |
| 8,040,620 | B2 * | 10/2011 | Wade et al. | 359/824 |

OTHER PUBLICATIONS

Co-pending U.S. Appl. No. 13/068,650, filed May 16, 2011, "Image Stabilization," assigned to the same assignee as the present invention, 30 pgs.

Co-Pending U.S. Appl. No. 12/658,508, filed Feb. 5, 2010, "Camera Shutter," assigned to the same assignee as the present invention.

Co-Pending U.S. Appl. No. 12/658,280, filed Feb. 5, 2010, "Camera Shutter and Position Control Thereof," assigned to the same assignee as the present invention.

Co-Pending U.S. Appl. No. 12/661,752, filed Mar. 23, 2010, "Camera Module Having a Low-friction Movable Lens," assigned to the same assignee as the present invention.

Co-Pending U.S. Appl. No. 12/660,989, filed Mar. 9, 2010, "Dynamic Lighting System," assigned to the same assignee as the present invention.

* cited by examiner

*Primary Examiner* — Thanh Tam Le
(74) *Attorney, Agent, or Firm* — Saile Ackerman LLC; Stephen B. Ackerman

(57) ABSTRACT

Systems and methods are disclosed for x-y tables wherein rolling elements of rolling-element bearings are transferring electrical energy between a fixed part of the x-y table and a movable part of the x-y table. The electrical energy transferred could be power to electrical devices as well as signals to and from devices on the movable part of the x-y table. Electrically conducting rolling elements are moving on electrically conducting grooves on the fixed and movable part of the x-y table. Conductor tracks on the fixed and movable part are connected to the grooves and to devices on the movable platform. In a preferred embodiment of the invention the x-y table is part of a camera wherein linear motors, preferably with integrated position sensing, are moving the x-y table back to a home position in case of a dislocation due to a mechanical shock. The invention allows an exact and fast positioning of an x-y table without requiring a flexible cable. The rolling-element bearings could be ball bearings, roller bearings, needle bearings, or other kind of bearings having electrically conductive rolling elements.

48 Claims, 3 Drawing Sheets

ENERGY TRANSFER VIA ROLLING ELEMENTS OF ROLLING-ELEMENT BEARINGS

RELATED APPLICATIONS

This application is related to the following US patent applications: titled "Image Stabilization", Ser. No. 13/068,650, filing date May 16,2011, titled "Camera Shutter", Ser. No. 12/658,508, filing date Feb. 5, 2010, titled "Camera Shutter and position control thereof", Ser. No. 12/658,280, filing date Feb. 5, 2010, and, titled "Camera Module having a low-friction movable lens", Ser. No. 12/661,752, filing date Mar. 23, 2010, , titled "Dynamic Lighting System", Ser. No. 12/660,989, filing date Mar. 9, 2010, and the above applications are herein incorporated by reference in their entirety.

BACKGROUND OF THE INVENTION (1) Field of the Invention

This invention relates generally to positioning of x-y tables and relates more specifically to transfer electrical energy to a movable part of the x-y table via rolling elements of rolling-element bearings guiding the x-y table.

(2) Description of the Prior Art

A precise positioning of x-y tables can be very difficult if signals or electrical power have to be brought forward or received from/to a moving x-y table. In prior art often a flexible cable is used for this purpose. The disadvantage of using a flexible cable for this purpose is that this kind of cable can act like a spring and impose an undesired force to the moving x-y table and hence a wrong or a slow positioning will occur. In case of e.g. a camera module having a lens barrel mounted on an x-y table that is guided by low friction ball bearings a fast and precise positioning has to be performed to accommodate the lens barrel to unintentional movements of the camera.

It is a challenge for the designers of small x-y tables to achieve a fast and precise positioning if ball bearings are used to guide the movements of the x-y table, if electrical energy has to be brought to/from the moving part of an x-y table.

Solutions dealing with ball bearings and electrical transmission are described in the following patents:

U.S. Patent (U.S. Pat. No. 7,109,610 to Tamai) teaches a wireless linear motor comprising: a stationary stator having permanent magnets; a movable stage having coils and a controller with a transceiver for wirelessly communicating with an external data processing system, the controller adapted to energize the coils to position the stage over the stator in response to control signals from the external system; and, a frame having first and second electrically conductive linear guides for slideably mounting the stage over the stator, wherein each linear guide has a stage portion attached to the stage through a first electrical insulator, a frame portion attached to the frame through a second electrical insulator, a plurality of ball bearings disposed between and electrically coupling the stage and frame portions, and a conductor coupling the stage portion to the controller for providing electrical power from an external power supply to the controller through the frame portion of each guide.

U.S. Patent (U.S. Pat. No. 7,043,146 to Semaza) discloses an all season fan with heated circulating blades includes heating elements mounted in slots defined in the rear surface of the fan blades for heating of air blown outwardly therefrom. Resilient biasing devices such as a bow springs are mounted in the fan blades extending over the slots to retain the heating elements in the slots.

U.S. Patent (U.S. Pat. No. 6,180,901 to Bauer et al.) discloses an electrical rotary switch for several switch positions having a control knob mounted in a housing supported on first, second and third ball bearings that, guided by a cage disk, roll in a housing groove formed by an axial wall and a radial wall against which the ball bearings are loaded under an applied force of a conical bearing surface of the control knob. Axial and radial wall bearing surfaces respectively have first and second contact segments and first, second and third contact bands thereon that extend out of the housing via terminal lugs, the first contact segment and first contact band being shorted by the first ball bearing in predetermined switch positions. In a last switch position, contact occurs between the second contact segment and the second and third contact.

SUMMARY OF THE INVENTION

A principal object of the present invention is to transfer electrical energy via rolling elements of one or more rolling-element bearings guiding an x-y table.

A further object of the present invention is to transfer electrical energy via balls of one or more ball bearings guiding an x-y table.

A further object of the invention is to drive a movable part of an x-y table by linear motors.

A further object of the invention is to drive a movable part of an x-y table by linear motors having integrated position sensing.

Moreover an object of the invention is moving a x-y table back to a home position in case of a dislocation due to a mechanical shock, wherein the x-y table is a part of a camera and is carrying a lens barrel or an image sensor.

Furthermore an objective of the invention is to position an x-y table, carrying electrical devices, exactly without requiring a flexible cable.

In accordance with the objects of this invention a method to transfer electrical energy via rolling elements of rolling-element bearings of an x-y table of a camera has been achieved. The method invented comprises, firstly, the following steps (1) providing a camera comprising a x-y table having a fixed part and a movable part, a number of linear motors to position the movable part of the x-y table, and rolling-element bearings to guide the movable part of the x-y table, wherein a number of rolling elements are made of electrically conductive material, and (2) deploying electrical conductor tracks as required on the fixed and on the movable part of the x-y table. Furthermore the method comprises (3) connecting the electrical conductor tracks with electrically conducting grooves of the one or more rolling-element bearings on the fixed part and on the movable part of the x-y table, and (4) connecting the electrical conductor tracks on the movable part of the x-y table with one or more electrical devices as desired.

In accordance with the objects of this invention a camera module having a precise bearing and low friction has been achieved. The camera firstly comprises: an image sensor, a shutter with an aperture function driven by a linear motor, said motor driving the shutter, wherein the motor has an integrated position sensing system, and a lens barrel. Furthermore the camera comprises a carrier, one or more actuators to move the lens barrel, and one or more rolling-element bearings between the lens barrel and the carrier to guide the movements of the lens barrel. Moreover the camera comprises a x-y table wherein rolling elements of rolling-element bearings are transferring electrical energy, comprising: a fixed part of the x-y table, comprising electrical conductor tracks, at least three linear motors wherein each linear motor comprises a coil wrapped around an iron and a permanent magnet deployed on a movable part of the x-y table; and electrical conducting grooves guiding a number of rolling elements of rolling-element bearings to move between the fixed part of the x-y table and the movable part of the x-y table, wherein the groves are electrically connected to said conductor tracks, and said number of rolling elements of rolling-element bearings, wherein at least two of the rolling elements of rolling-element bearings are made of electrically conducting material. Finally the x-y table comprises said movable part of the x-y table, comprising electrical conductor tracks connected to electrical conducting grooves on the movable part and to electrical devices deployed on the movable part of the x-y table, and said electrically conducting grooves on the movable part of the x-y table guiding the rolling elements of the rolling-element bearings to move between the fixed part and the moving part of the x-y table.

In accordance with the objects of this invention an x-y table wherein rolling elements of rolling-element bearings are transferring electrical energy has been achieved. The x-y table firstly comprises a fixed part of the x-y table, comprising electrical conductor tracks, at least three linear motors wherein each linear motor comprises a coil wrapped around an iron and a permanent magnet deployed on a movable part of the x-y table, and electrical conducting grooves guiding a number of rolling elements of rolling-element bearings to move between the fixed part of the x-y table and the movable part of the x-y table, wherein the groves are electrically connected to said conductor tracks. Furthermore the x-y table comprises said number of rolling elements of rolling-element bearings, wherein at least two of the rolling elements of rolling-element bearings are made of electrically conducting material, and said movable part of the x-y table, comprising electrical conductor tracks connected to electrical conducting grooves on the movable part and to electrical devices deployed on the movable part of the x-y table, and said electrically conducting grooves on the movable part of the x-y table allowing the rolling elements of rolling-element bearings to move between the fixed part and the moving part of the x-y table.

In accordance with the objects of this invention a camera capable of holding together rolling-element bearings used to guide a movable part of the camera has been achieved. The camera invented firstly comprises: a movable lens barrel, a first and a second magnet, wherein the first magnet is fastened on the moving lens barrel and the second magnet is deployed oppositely to the first magnet on a fixed part of the camera and wherein the first and the second magnets have a same magnetic polarity on their neighboring sides, hence pushing the lens barrel onto rolling-element bearings, and said rolling-element bearings wherein the rolling elements of each rolling-element bearings are moving between the lens barrel and a fixed part of the camera.

BRIEF DESCRIPTION OF THE DRAWINGS

In the accompanying drawings forming a material part of this description, there is shown:

FIG. 3 shows a preferred embodiment of a shutter of a camera wherein an x-y table of the present disclosure is applied to.

FIG. 4 shows a top view of a top plate of the x-y table the present invention is applied to.

DESCRIPTION OF THE PREFERRED EMBODIMENTS

Systems and methods for transferring electrical energy via rolling elements of rolling-element bearings have been achieved. In a preferred embodiment ball bearings are guiding an x-y table of a camera, wherein at least two linear motors move a x-y table, carrying an optical sensor or a lens barrel of the camera, in order to adjust the optical sensor or the lens barrel to unintentional movements of the camera, e.g. as disclosed in the patent application titled "Image Stabilization", Ser. No. 13/068,650, filing date May 16,2011.

It should be emphasized that besides ball bearings other rolling element bearings, such as e.g. roller bearings, tapered roller bearings, needle bearings, etc, can be used as well for the invention as long as all or some rolling elements of the bearings consist of electrically conductive material.

By using balls of ball bearings, or other rolling elements of rolling-element bearings, to transfer electrical energy between a fixed and a moving part of an x-y table e.g. an exact and fast positioning of the x-y table or other applications can be achieved. In prior art often flexible cables are used to bring electrical power or signals to/from the moving part of a x-y table. A disadvantage of using flexible cables for such a purpose is that a flexible cable can have the effect of a spring and can hence impose a force to the moving part and subsequently slow down or hinder an exact positioning of the x-y table.

Figure 1:
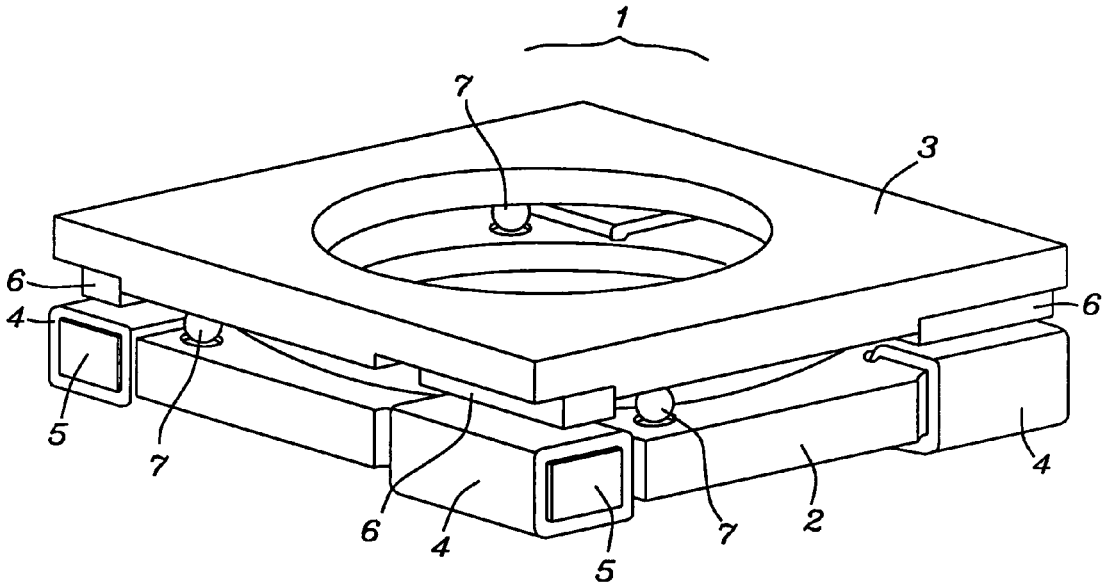
FIG. 1 illustrates an oblique 3-dimensional view of a preferred embodiment of the present invention.

FIG. 1 illustrates an oblique 3-dimensional view of a preferred embodiment of the present invention. It shows an x-y table 1 comprising a fixed part 2 and a movable part 3. There are four linear motors deployed on the x-y table 1 each comprising a coil 4 wrapped around an iron 5, and a permanent magnet 6 deployed on the movable part 3 of the x-y table 1 neighboring a correspondent coil 4. The movable part 3 of the x-y table is guided by balls 7 of ball bearings.

Figure 3:
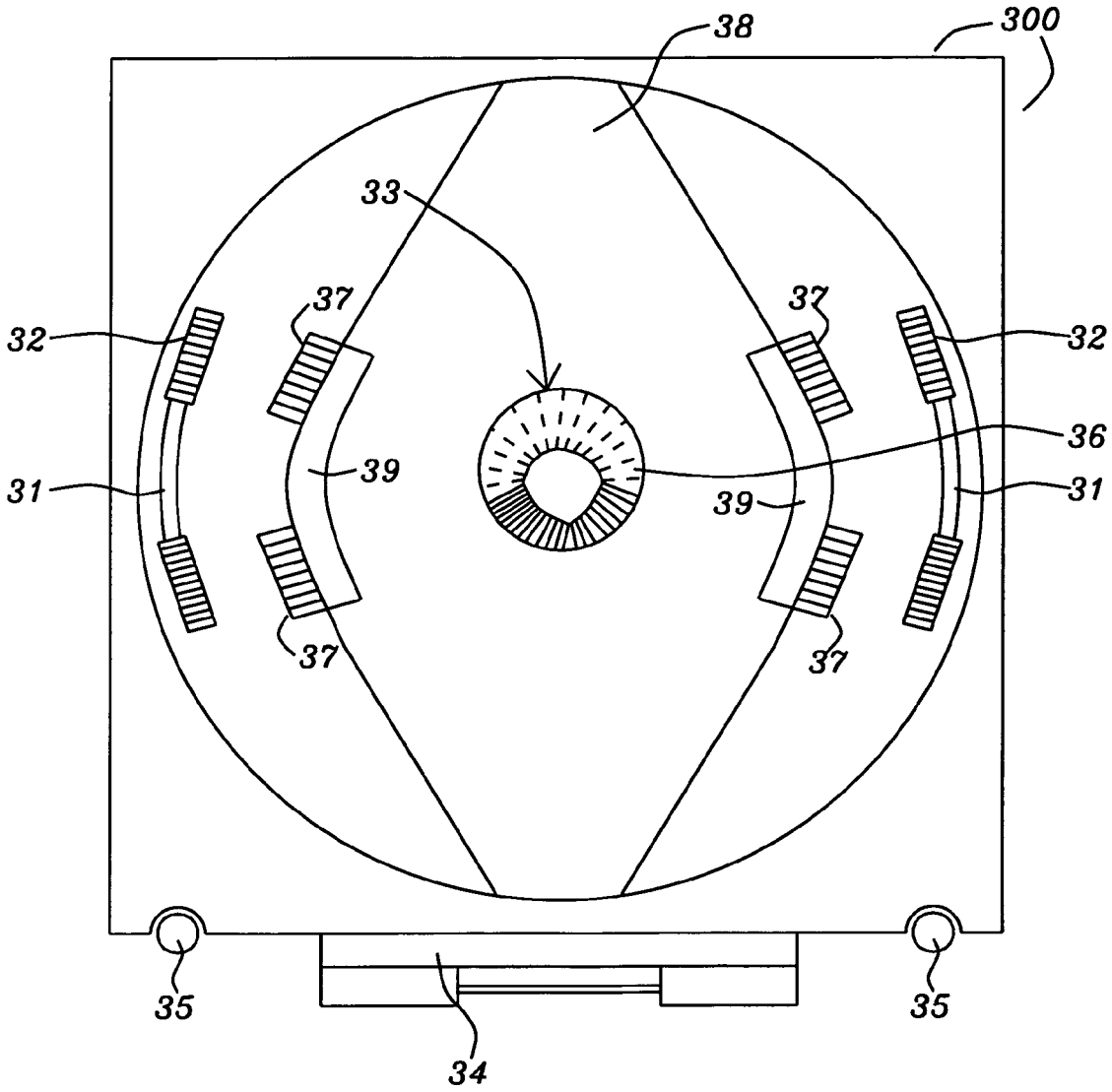

The balls 7 are made of electrically conductive material as e.g. steel, brass, etc. In both fixed 2 and moving part 3 the balls 7 are moving in grooves (not shown) made of suitable electrically conductive material such as copper. Hence the balls 7 are able to transfer electrical energy from the fixed part 2 to the movable part 3. The electrical energy transferred could be power required by any devices on the movable part, also modulated electrical power required by linear motors moving a lens barrel to a focius position, deployed on the movable platform, or a linear motor moving a shutter, or signals, for example positioning signals from/to the shutter or from/to the lens barrel. In a preferred embodiment of the invention at least a part of the linear motors are provided with an integrated position sensing as disclosed in the patent application titled "Camera Shutter" Ser. No. 12/658,508, filing date Feb. 5, 2010. Other motors having a position control could be used as well. Electrical conductor tracks (not shown) conduct the energy on the fixed and movable platform. FIG. 3 shows a preferred embodiment of a shutter of a camera wherein an x-y table of the present invention is applied to. The coils 32 of two bidirectional linear motors driving shutter blades 36 are wrapped around iron coil cores 31. The coils 32 and iron coil cores 31 are mounted on the case of the shutter and inside of a lens barrel of a zoom lens system. Furthermore in a preferred embodiment each linear motor driving shutter blades comprises two magnets 37 fastened on shutter blades 36 or on a movable yoke, which is mechanically connected to the shutter blades 36. The magnets are moved by magnetic force depending upon the currents through the coils 32 and the linear motors are moving the shutter blades 36 directly or via the yoke 38. The opening 33 defines the size of the aperture.

It should be noted that four balls, as shown in FIG. 1, or at least two balls, or at least two other rolling elements, can be used to transfer electrical energy. Some balls can be used to transfer electrical power to a device deployed on the movable platform and one or more balls could be used to transfer any signals. In preferred embodiment two balls are used to transfer electrical power, e,g to a linear motor, i.e. one ball is transferring positive power and the other ball of the two balls is transferring negative power, wherein a third ball is transferring electrical signals, e.g position signals of the linear motor.

Furthermore it should be noted that three motors and/or three balls can be used as well. Using only three motors and three balls has the advantage that all 3 balls will have same contact pressure. The energy transfer of the present invention can also be used to guide a lens barrel to perform a autofocus operation. In this case, if the shutter is mounted on the lens barrel, it is possible to supply the shutter with electrical power and signal connections. Generally, the present invention can be applied to all ball bearings requiring electrical power or signal connections on the moving part of the ball bearings.

In case four or more balls, or four or more other rolling elements, are deployed springs should be used with the rolling elements to ensure a sufficient electrical contact is achieved for all rolling elements transmitting electrical energy.

Figure 4:
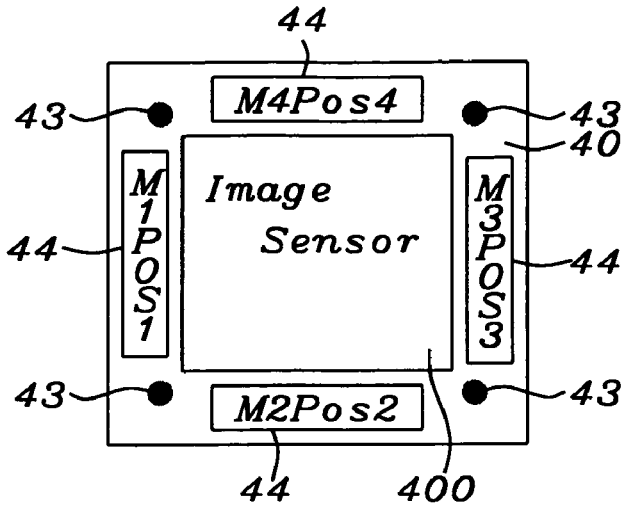
Figure 5:
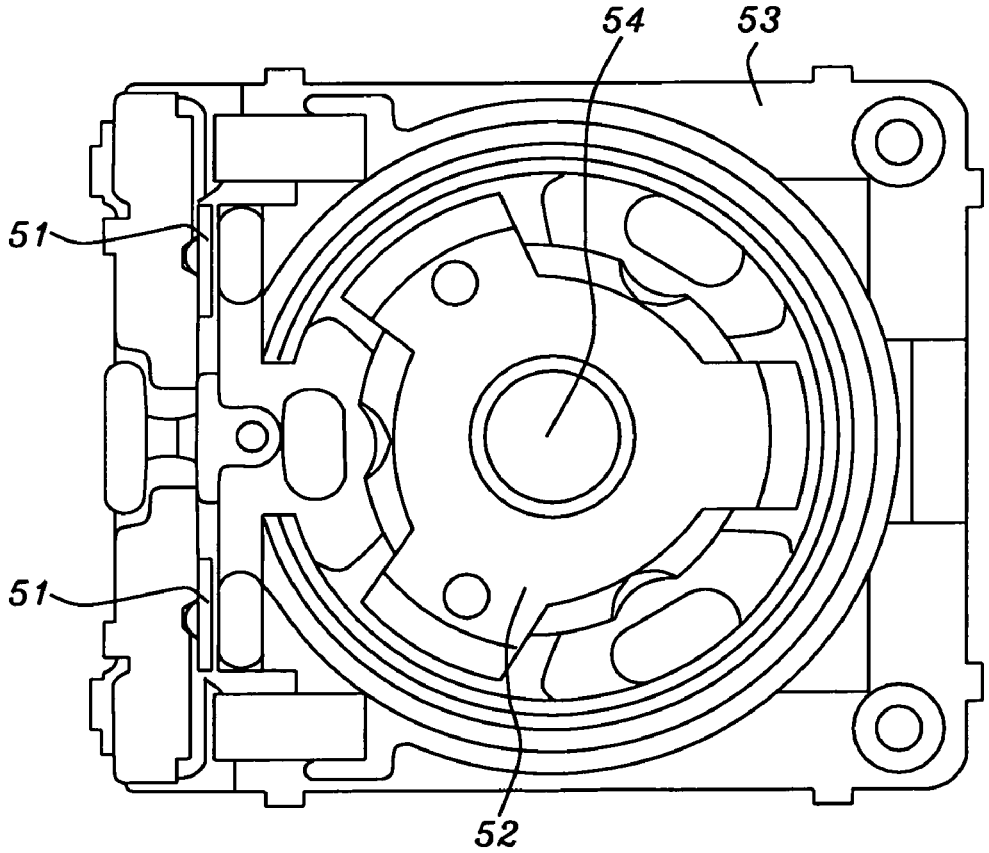
FIG. 5 shows a top view of a camera module using ball bearings according to the present disclosure.

The camera module invented furthermore comprises an integrated circuit (IC) controlling the actuators of the present invention, an image sensor, a shutter which also can be used as an aperture, and a movable lens barrel in order to support an autofocus function of the camera. This IC also controls actuators with integrated position control to move the lens barrel of the camera module as required as disclosed in the patent application titled "Camera Module having a low-friction movable lens", Ser. No. 12/661,752, filing date Mar. 23, 2010, and in the patent application titled "Twin-actuator configuration for a camera module", Ser. No. 12/661,755, filing date Mar. 23, 2010. Furthermore this IC also controls one or more motors with integrated position control to move shutter blades of the camera module as disclosed in the patent application titled "Camera Shutter and position control thereof", Ser. No. 12/658,280, filing date Feb. 5, 2010. FIG. 4 shows a top view of top plate 40. The square in the middle indicates an image sensor 400. Alternatively the x-y table could be carrying a lens barrel. Four motors 44 having each a position sensor and four balls 43 are deployed. Fiq. 5 shows a top view of an embodiment a camera module of the present invention. It shows a movable lens barrel 52 containing one or more lenses 54, ball bearings 51 to achieve minimal friction of the movement of the lens barrel and a carrier 53. The lens barrel 52 is moving up and down with respect to the carrier 53. The ball bearing system 51 is guiding the lens barrel 52 containing the lens 54.

Figure 2:
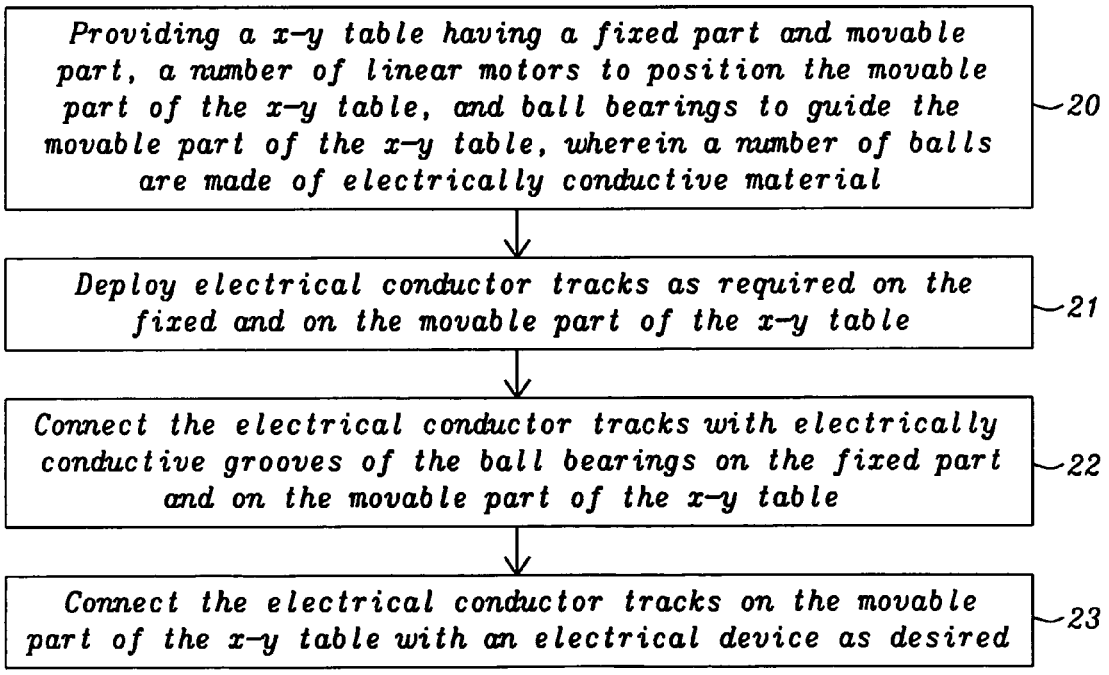
FIG. 2 illustrates a flowchart of a method to transfer electrical energy via balls of ball bearings of a x-y table.

FIG. 2 illustrates a flowchart of a method to transfer electrical energy via balls of ball bearings of a x-y table. In a preferred embodiment a lens barrel or an image sensor of a camera is positioned to a home position in case of a mechanic shock.

A first step 20 illustrates provision of a camera comprising a x-y table having a fixed part and a movable part, a number of linear motors to position the movable part of the x-y table, and ball bearings to guide the movable part of the x-y table, wherein a number of balls are made of electrically conductive material. As mentioned earlier, other rolling elements of rolling element bearings could be used as well. Such a movable part could carry for instance a lens barrel to be moved in a focus position. Another application could be moving a shutter of a camera. A second step 21 describes deploying electrical conductor tracks as required on the fixed and on the movable part of the x-y table. The next step 22 of the method invented describes connecting the electrical conductor tracks with electrically conducting grooves of the ball bearings on the fixed part and on the movable part of the x-y table. The last step 23 illustrates connecting the electrical conductor tracks on the movable part of the x-y table with one or more electrical devices as desired.

While the invention has been particularly shown and described with reference to the preferred embodiments thereof, it will be understood by those skilled in the art that various changes in form and details may be made without departing from the spirit and scope of the invention.

What is claimed is:

1. A method to transfer electrical energy via rolling elements of one or more rolling-element bearings of an x-y table of a camera, comprising the following steps:

(1) providing a camera comprising a x-y table having a fixed part and a movable part, a number of linear motors to position the movable part of the x-y table, and one or more rolling-element bearings to guide the movable part of the x-y table, wherein a number of rolling elements are made of electrically conductive material;

(2) deploying electrical conductor tracks as required on the fixed and on the movable part of the x-y table;

(3) connecting the electrical conductor tracks with electrically conducting grooves of the one or more rolling-element bearings on the fixed part and on the movable part of the x-y table; and (4) connecting the electrical conductor tracks on the movable part of the x-y table with one or more electrical devices as desired.

2. The method of claim 1 wherein four linear motors are driving the movable part of the x-y table.

3. The method of claim 1 wherein three linear motors are driving the movable part of the x-y table.

4. The method of claim 1 wherein at least a part of said linear motors has an integrated position sensing capability.

5. The method of claim 1 wherein said x-y table is positioned to a home position after a mechanical shock.

6. The method of claim 1 wherein at least one rolling element is used to transfer electrical power.

7. The method of claim 1 wherein three rolling elements are used for a rolling-element bearing.

8. The method of claim 1 wherein four rolling elements are used for a rolling-element bearing.

9. The method of claim 1 wherein said rolling elements are balls.

10. The method of claim 1 wherein the rolling elements are made of steel.

11. The method of claim 1 wherein the rolling elements are made of brass.

12. The method of claim 1 wherein the method is applied for an optical stabilization of a camera in case of a mechanical shock.

13. The method of claim 12 wherein a lens barrel is stabilized by the x-y table.

14. The method of claim 13 wherein a shutter is mounted on said lens barrel and wherein said shutter is guided by one or more rolling-element bearings having electrically conductive rolling-elements.

15. The method of claim 1 wherein an image sensor is stabilized by the x-y table.

16. The method of claim 1 wherein said rolling elements are cylinders.

17. A camera module having a precise ball bearing and low friction, comprises:

an image sensor;

a shutter with an aperture function driven by a linear motor;

said motor driving the shutter, wherein the motor has an integrated position sensing system;

a lens barrel;

a carrier;

one or more actuators to move the lens barrel;

one or more rolling-element bearings between the lens barrel and the carrier to guide the movements of the lens barrel; and an x-y table wherein rolling elements of said one or more rolling-element bearings are transferring electrical energy, comprising:

a fixed part of the x-y table, comprising electrical conductor tracks;

at least three linear motors wherein each linear motor comprises at least one coil wrapped around an iron and a permanent magnet deployed on a movable part of the x-y table; and electrical conducting grooves guiding a number of rolling elements of one or more rolling-element bearings to move between the fixed part of the x-y table and the movable part of the x-y table, wherein the groves are electrically connected to said conductor tracks;

a number of said rolling elements of the rolling-element bearings, wherein at least two of the rolling elements are made of electrically conducting material; and said movable part of the x-y table, comprising electrical conductor tracks connected to electrical conducting grooves on the movable part and to electrical devices deployed on the movable part of the x-y table; and said electrically conducting grooves on the movable part of the x-y table guiding the rolling elements to move between the fixed part and the moving part of the x-y table.

18. The camera module of claim 17 wherein said x-y table is guiding the lens barrel.

19. The camera module of claim 17 wherein four linear motors are driving the movable part of the x-y table.

20. The camera module of claim 17 wherein three linear motors are driving the movable part of the x-y table.

21. The camera module of claim 17 wherein at least a part of said linear motors has an integrated position sensing capability.

22. The camera module of claim 17 wherein said x-y table is carrying the lens barrel.

23. The camera module of claim 22 wherein a shutter is mounted on said lens barrel and wherein said shutter is guided by a ball bearing having electrically conductive balls.

24. The camera module of claim 17 wherein said x-y table is positioned to a home position after a mechanical shock.

25. The camera module of claim 17 wherein the x-y table is used for an optical stabilization of the camera in case of a mechanical shock.

26. The camera module of claim 17 wherein the image sensor is stabilized by the x-y table.

27. The camera module of claim 17 wherein the lens barrel is stabilized by the x-y table.

28. The camera module of claim 17 wherein said rolling elements are balls.

29. The camera module of claim 17 wherein said rolling elements are cylinders.

30. A x-y table wherein rolling elements of one or more rolling-element bearings are transferring electrical energy, comprising:

a fixed part of the x-y table, comprising electrical conductor tracks;

at least three linear motors wherein each linear motor comprises at least one coil wrapped around an iron and a permanent magnet deployed on a movable part of the x-y table; and electrical conducting grooves guiding a number of rolling elements of rolling-element bearings to move between the fixed part of the x-y table and the movable part of the x-y table, wherein the grooves are electrically connected to said conductor tracks;

a number of said rolling elements of the rolling-elements bearings, wherein at least two of the rolling elements are made of electrically conducting material; and said movable part of the x-y table, comprising electrical conductor tracks connected to electrical conducting grooves on the movable part and to electrical devices deployed on the movable part of the x-y table; and said electrically conducting grooves on the movable part of the x-y table guiding the rolling elements to move between the fixed part and the moving part of the x-y table.

31. The x-y table of claim 30 wherein four linear motors are driving the movable part of the x-y table.

32. The x-y table of claim 30 wherein three linear motors are driving the movable part of the x-y table.

33. The x-y table of claim 30 wherein at least a part of said linear motors has an integrated position sensing capability.

34. The x-y table of claim 30 wherein said x-y table is positioned to a home position after a mechanical shock.

35. The x-y table of claim 30 wherein at least one rolling element is used to transfer electrical power.

36. The x-y table of claim 30 wherein three rolling elements are used for a rolling-element bearing.

37. The x-y table of claim 30 wherein four rolling elements are used for a rolling-element bearing.

38. The x-y table of claim 30 wherein each rolling element is supported by springs.

39. The x-y table of claim 30 wherein rolling elements are made of electrically conducting material.

40. The x-y table of claim 39 wherein the rolling elements are made of steel.

41. The x-y table of claim 39 wherein the rolling elements are made of brass.

42. The x-y table of claim 30 wherein the method is applied for an optical stabilization of a camera in case of a mechanical shock.

43. The x-y table of claim 30 wherein a lens barrel is stabilized by the x-y table.

44. The x-y table of claim 30 wherein an image sensor is stabilized by the x-y table.

45. The x-y table of claim 30 wherein said x-y table is carrying a lens barrel.

46. The x-y table of claim 45 wherein a shutter is mounted on said lens barrel and wherein said shutter is guided by one or more rolling-element bearings having electrically conductive rolling elements.

47. The x-y table of claim 30 wherein said rolling elements are balls.

48. The x-y table of claim 30 wherein said rolling elements are balls.

* * * * *